United States Patent [19]

Timmer

[11] 4,452,452

[45] Jun. 5, 1984

[54] APPARATUS FOR STRINGING A RACKET FRAME

[75] Inventor: Frans F. Timmer, Callantsoog, Netherlands

[73] Assignee: Intervention, Ltd., Channel Islands

[21] Appl. No.: 444,853

[22] Filed: Nov. 26, 1982

[30] Foreign Application Priority Data

Dec. 10, 1981 [NL] Netherlands ..... 8105557

[51] Int. Cl.[3] ..... A63B 51/14

[52] U.S. Cl. ..... 273/73 A; 28/151

[58] Field of Search ..... 273/73 A, 73 B, 73 R; 139/29, 34; 28/151, 152

[56] References Cited

U.S. PATENT DOCUMENTS 1,943,400 1/1934 Tarber et al. ..... 273/73 A 2,463,365 3/1949 Epstein ..... 139/34

OTHER PUBLICATIONS

"Cross-Stringing-Guide".

*Primary Examiner*—Richard C. Pinkham

*Assistant Examiner*—Matthew L. Schneider

*Attorney, Agent, or Firm*—Kramer & Brufsky

[57] ABSTRACT

An apparatus for lacing the lateral strings in a racket frame which has already been strung with the longitudinal strings. The apparatus consists of a lower beam provided in its upper surface with two staggered longitudinal rows of vertical slots, the spacing of the slots of each row corresponding to twice the pitch distance of the longitudinal strings of the racket frame. The corresponding slots of the two rows form pairs of slots and the upper surface of the lower beam forms string support surfaces between the pairs of slots. An upper gripper beam is vertically movable with respect to the lower beam. The gripper beam has downwardly facing string surfaces arranged in pairs associated with the pairs of slots of the lower beam. The gripping surfaces of each pair are separated by a downwardly extending lug portion. The apparatus is mounted crosswise on the longitudinal strings with the lower beam extending below and the gripper beam extending above the strings in a position in which alternate longitudinal strings are situated opposite the slots of one of the rows. Upon closing the apparatus, a channel is formed through the longitudinal strings allowing easy passage of a lateral string therethrough.

15 Claims, 9 Drawing Figures

28
27
2
16
17
36″
3
36′
34
36″
2
37
36′
15
13
14
4
5
1

28
16
17
11
13
14
38
3
11
2
36′
36″
4
15
5
7
1

28
16
17
3
2
37′
36″
36′
15
4
5
7
13
14
1

APPARATUS FOR STRINGING A RACKET FRAME

BACKGROUND OF THE INVENTION

The invention relates to the stringing of racket frames and particularly to an apparatus for lacing the lateral strings in such a frame after the frame has already been strung with the longitudinal strings thereof. In the process of stringing rackets such as tennis rackets or squash rackets, it is the usual practice to clamp the racket frame onto a support which is rotatable on a verticle shaft and to first string the frame with the longitudinal strings (forming parts of a single length of string) which strings are properly tensioned and secured. Next the lateral strings are applied which likewise form parts of a single continuous length of string. For lacing a lateral string, the string is inserted through a string hole of the frame and is passed alternately under one longitudinal string and over the adjacent longitudinal string in the manner of a flat weave, whereupon the string is passed through the opposite string hole of the frame and is properly tensioned and temporarily secured by a string clamp until the next lateral string has been laced in, tensioned and secured. Lacing the lateral strings by hand is a time consuming operation which demands considerable manual dexterity. In pulling the string through, these rub along the several longitudinal strings which causes wear and, in the case of catgut strings, leads to fraying, particularly if on lacing the first of the lateral strings, a great length of string has to be drawn through the frame.

To facilitate the lacing of the lateral strings, it is known to use an apparatus comprising a lower first beam having in its upper surface, a row of vertical slots spaced at a distance corresponding to twice the average pitch distance between the longitudinal strings of the racket frame to be stringed, the upper surface of said first beam forming a plurality of upper string support surfaces between these slots. Said first beam further contains a longitudinal slot in which an upper gripper second beam is vertically slidably mounted, an operating mechanism being provided for moving the gripper second beam between a raised and a lowered position with respect to the lower first beam. The gripper second beam is provided with upwardly extending wire hooks which, in the upper or open position of the gripper second beam and with the apparatus placed crosswise against the underside of the longitudinal strings, can be hooked over alternate longitudinal strings whereby on closing the apparatus by moving the gripper means beam downward with respect to the lower first beam these strings are pulled into the slots of the lower first beam; whereas, the remaining longitudinal strings find support on the support surfaces of the lower first beam. In this way, a channel is formed through the longitudinal strings through which a lateral string can be easily passed. This known apparatus, however, has the disadvantage that after lacing-in a lateral string and again opening the apparatus, the hooks thereof must be removed from the longitudinal strings which they engage and must be placed over the adjacent longitudinal strings in order that the location of the channel through the longitudinal strings can be changed when the apparatus is again closed to obtain the required flat weave when introducing the next lateral string. This known apparatus has the further disadvantage that when pulling through the lateral strings, the latter still chafe along the longitudinal strings supported on the support surfaces of the lower first beam.

BRIEF SUMMARY OF THE INVENTION

The invention has for its object to provide an apparatus of the above-mentioned type which obviates the drawbacks of the known apparatus. Particularly, it is an object of the invention to provide an apparatus of the kind described which is easy to operate and allows the stringing of the lateral strings of a racket frame in a quick and efficient manner in which the lateral strings when being laced-in move substantially free of the longitudinal strings.

The apparatus of the invention comprises a first beam containing two rows of vertical slots with the slots of one row alternating with the slots of the other row to form pairs of slots, each comprising one slot from each row, the upper surface of said beam forming upper string support surfaces between these pairs of slots. The slots of each row have a spacing at least approximately corresponding to twice the average pitch of the longitudinal strings of the racket frame. The apparatus further comprises a second gripper beam adapted to be situated above said first beam, said second gripper beam vertically movable with respect to said first beam between open and closed positions, said second gripper beam having a plurality of downwardly facing string gripping surfaces, one associated with each slot of said first beam and, like said slots, arranged in pairs, the gripping surfaces of at least the majority of the gripping surface pairs being separated by a downwardly extending lug. By the provision of the two staggered rows of slots in the lower first beam and the corresponding gripping surfaces on the upper second gripper beam, it is now possible after lacing-in a lateral string to quickly change the channel between alternate longitudinal strings by shifting the apparatus in a lateral direction with respect to the longitudinal strings so as to move these strings from a first position in alignment with the slots of one row to a second position in alignment with the slots of the other row without the necessity of removing the apparatus from the lateral strings.

The expressions "lower" first beam and "upper" second beam have been used to indicate the normal position of the apparatus on the strings although it will be clear that the apparatus could also be used in an upside down position.

BRIEF DESCRIPTION OF THE DRAWINGS

Further objects and novel features of the invention will appear from the following description in conjunction with the accompanying drawings showing preferred embodiments of the invention. In the drawings.

DETAILED DESCRIPTION

Figure 1:
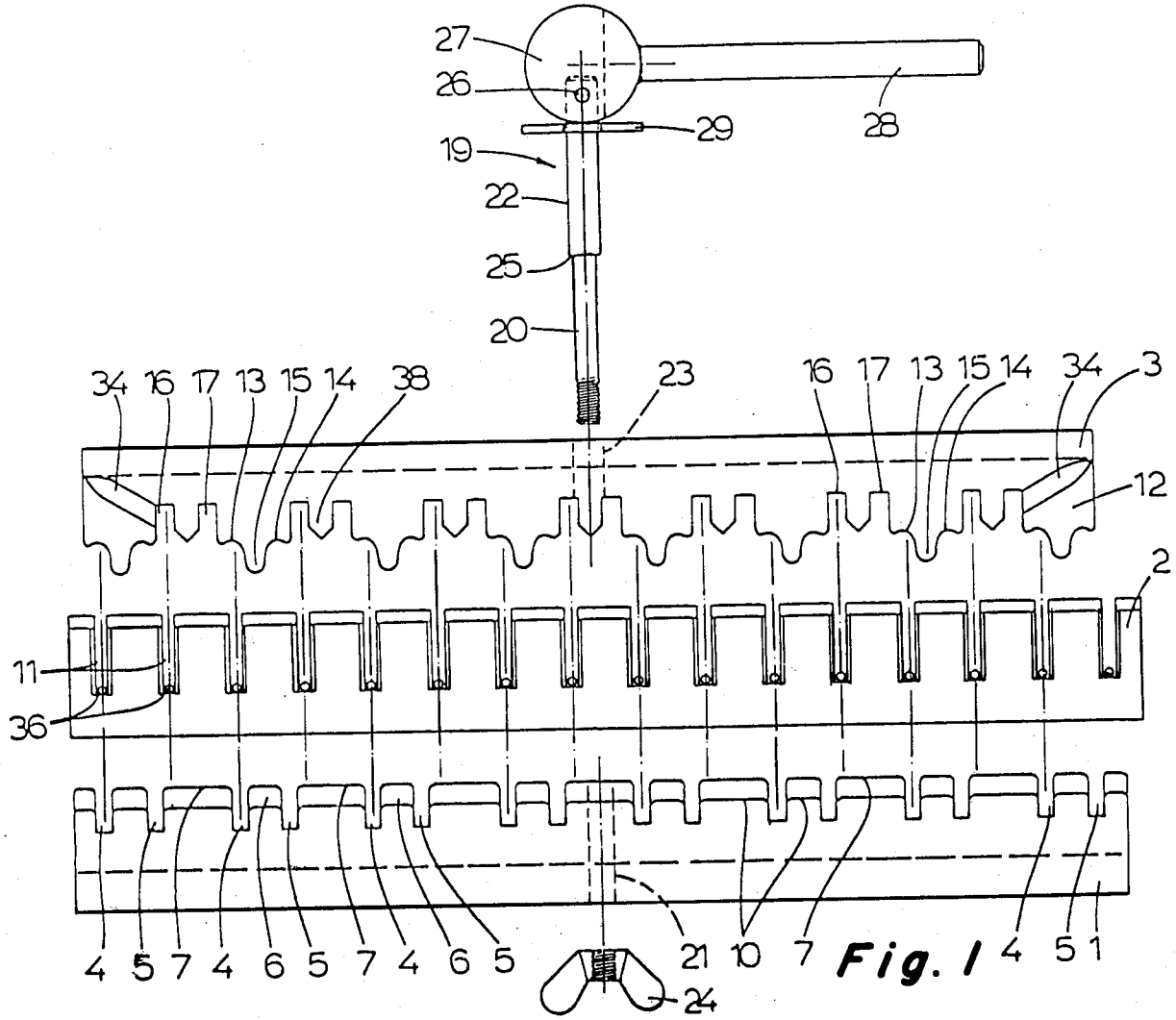
FIG. 1 is a side view of the apparatus in which the components thereof are shown in their dissembled condition.

The apparatus shown in FIGS. 1 to 6 for lacing in the lateral strings in a racket frame which has already been strung with the longitudinal strings comprises a lower first beam 1, an intermediate comb 2 and an upper second beam 3. The lower first beam is provided with two groups of vertical slots 4 and 5 which are open at the top, the slots of each group lying at equal distances from one another which mutual distance corresponds at least approximately to twice the average pitch distance beween the longitudinal strings of the racket frame to be strung. The slots of one group alternate with the slots of the other group, the distance between a slot of one group and the corresponding adjacent slot of the other group being smaller than the pitch distance between the longitudinal strings in such a manner that each of the slots 4 and the slots 5 lying to the right thereof as seen in FIG. 1 together make a pair of slots separated by a short intermediate beam portion 6 and that the upper sides of the longer beam portions lying between successive pairs of slots form support surfaces 7 for the longitudinal strings. A longitudinal groove 8 is formed in the lower first beam 1 alongside the support surfaces 7 and fittingly receives the comb 2 which is freely slidable therein. Finally the lower first beam 1 is provided at both sides with recessed shoulder surfaces 9 and 10 which extend the whole length of the beam.

The comb 2 is provided with comb slots 11 having a pitch distance equal to half the pitch distance between the slots 4 and 5, respectively, in the lower first beam 1. The comb 2 has a height greater than the depth of the longitudinal groove 8 in the lower first beam 1 so that the comb lying in this groove extends some distance above the support surfaces 7.

The upper second beam 3 has a cross-section of approximately "U"-shape with two opposed faces 12 which can accomodate the lower first beam 1 therebetween and which are rounded-off on their undersides. A longitudinal groove 18 is formed in the upper second beam 3 which can accomodate the upper side of the comb 2. A row of downwardly directed, concavely curved hook-shaped gripping surfaces 13 and 14 are formed in each of the faces 12, these gripping surfaces 13 and 14 being associated with the slots 4 and 5, respectively, in the lower first beam 1 such that they may lie with their deepest parts directly above these slots. Thus each pair of gripping surfaces 13 and 14 are associated with one of said pairs of slots 4 and 5, respectively, and the gripping surfaces of each pair are separated from another by a vertically downward extending lug 15 therebetween whereby a longitudinal string can be moved under a gripping surface 13 only from the left side or under a gripping surface 14 only from the right side. Furthermore, slots 16 and 17 are formed in the faces 12 between these pairs of gripping surfaces in which the distance between the slots 16 and the gripping surfaces 13 and also the distance betweeen the slots 17 and the gripping surfaces 14 are again equal to the pitch distance of the comb slots 11 and thus to the pitch distance between the longitudinal strings of the racket.

The first and second beams 1 and 3 can be coupled to one another by means of an eccentric-mechanism 19 comprising a coupling-pin having a lower threaded pin portion 20 which can be pushed through a bore 21 in the lower first beam 1, and an upper pin portion 22 of a larger diameter which fits into a bore 23 in the upper second beam 3. A winged nut 24 can be screwed on the threaded end of the pin portion 20 extending through the lower first beam 1 and on tightening this nut a shoulder 25 formed intermediate the pin portions 20 and 22 is pulled up against the support surface 7 of the lower first beam 1. A fork-shaped eccentric disc 27 carrying a handgrip 28 is rotatably mounted on a cross-pin 26 affixed to the upper end of the pin portion 22, which eccentric disc can engage the upper surface of the upper second beam 3 via the thrust-ring 29 lying therebetween.

Figures 4, 5, 6:
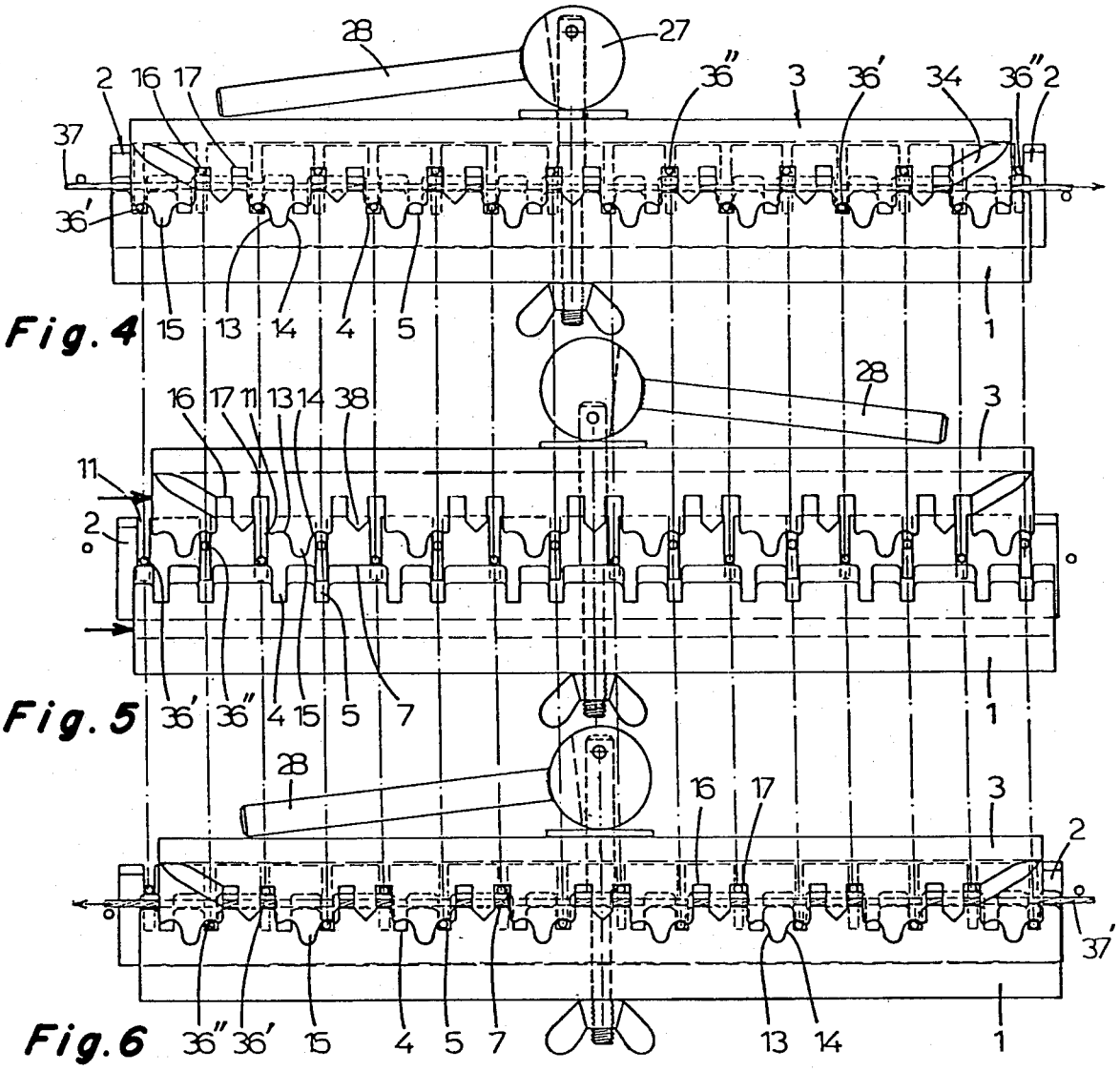
FIG. 4 is a side view of the apparatus when placed on the longitudinal strings of a racket frame and shown in the first one of two closed positions.
FIG. 5 is a similar view of the apparatus in a laterally displaced open position with respect to FIG. 4.
FIG. 6 is again a view similar to that shown in FIG. 4 of the apparatus and as seen in a second closed position and corresponding to the lateral position of FIG. 5.

With the apparatus in its open position as illustrated in FIG. 5 and with the handgrip 28 moved over to one side, the upper second beam 3 can be pushed up on the pin portion 22 for such a distance that the gripping surfaces 13 and 14 lie above the support surfaces 7 of the lower first beam 1 with substantial clearance therebetween.

When, however, the handgrip 28 is turned to the closed position shown in FIGS. 4 and 6, the eccentric disc 27 pushes the upper second beam 3 downward to such a degree that the gripping surfaces 13 and 14 lie only at a small distance above the bottom of the slots 4 and 5 in the lower first beam 1.

Figure 3:
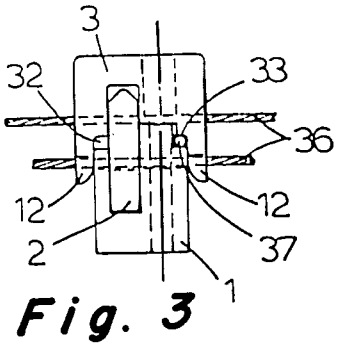
FIG. 3 is a cross-section of the apparatus in the closed condition.

As can be seen from FIG. 3, in this closed position of the apparatus, lacing channels 32 and 33 are formed between the shoulder surfaces 9 and 10 of the lower first beam 1 and corresponding shoulder surfaces 30 and 31 of the upper second beam 3. These lacing channels 32 and 33 lie enclosed between these shoulder surfaces, the faces 12 of the upper second beam 3, and the comb 2 or the body of the lower first beam 1, respectively. The lacing channels 32 and 33 extend over the whole length of the apparatus at a height below the support surfaces 7 and above the gripping surfaces 13 and 14.

For achieving another object yet to be described, string insertion slots 34 are formed in each of the four corners of the upper second beam 3 which insertion slots extend obliquely downward and inward and open into the lacing channel 32 or 33 adjacent the outermost slots 16 and 17 of the upper second beam 3.

The operation of the apparatus will be further described with reference to FIGS. 3 to 7 of the drawings.

After the racket frame has been strung with the longitudinal strings in the known manner, the apparatus is placed on these longitudinal strings. To this end, the comb 2 is first pushed onto the strings 36 preferably from the underside; whereafter, the lower first beam 2 and the upper second beam 3 are pushed onto the comb and connected together by the pin 20, 22 and the winged nut 24. With the handgrip 28 in the open position, the assembly of first and second beams 1 and 3 is pushed, for instance, to the left until the concerned longitudinal strings 36', i.e. the strings lying in the odd comb slots counting from the left side as seen in FIG. 4, engage against the lugs 15. Through this, these odd longitudinal strings come to lie below the gripping surfaces 13 whilst the intermediate even longitudinal strings will then lie below the slots 16 of the upper second beam 3. If the handgrip 28 is now turned to close the apparatus, the odd longitudinal strings 36' slide to the deepest points of the hood-shaped gripping surfaces 13 and are then pushed into the slots 4 of the lower first beam 1 by these gripping surfaces. Simultaneously, the even longitudinal strings 36" are pushed into the slots 16 of the upper second beam 3 by the support surfaces 7 of the lower first beam, see FIG. 4. Thus a gap or channel is formed between the even and odd longitudinal strings whereby a lateral string 37 can be pushed through the lacing channel 33 (or 32) so formed (see also FIG. 3). Feeding a lateral string through this lacing channel 33 is very easily accomplished and without touching the longitudinal strings 36. After pulling through and tensioning the lateral string 37, the handgrip 28 is again turned to open the apparatus whereby the lacing channels 32 and 33 are opened sideways and the tensioned string springs out of the channel concerned. In the open position of the apparatus, the comb 2 still projects into the slot 18 of the upper second beam 3. The apparatus is then shifted in the longitudinal direction of the racket through the required distance along the longitudinal strings for the lacing in of the next lateral string. Following this, the first and second beams 1 and 3 are moved over a short distance to the right, again as seen in FIGS. 4 to 6, until the even longitudinal strings 36" lie between the gripping surface 14 and the slots 5 of the lower first beam 1 and the odd longitudinal strings 36' lie on the supporting surfaces 7 below the slots 17 of the upper second beam 3 (see FIG. 5). During this shifting movement, which is again limited by the lugs 15, the comb 2 remains in its place while the first and second beams 1 and 3 slide over the comb 2. In FIG. 5, it will be seen that the upper edges of the slots 4 and 5 are rounded-off and that the cam-like face portions 38 lying between the slots 16 and 17 of the upper second beam 3 are symetrically chamfered on their undersides in order to guide the longitudinal strings into the respective slots 4, 5 and 16, 17 when the apparatus is closed.

In FIG. 5, furthermore, it will be seen that with the apparatus in the open position, the even longitudinal strings 36", which in fact cross over the last laced-in lateral string 37, lie somewhat higher than the odd longitudinal strings 36' crossing under this lateral string 37. If following this, the handgrip 28 is again actuated, the apparatus assumes the closed position as shown in FIG. 6 in which the odd longitudinal strings 36' are pressed against the support surfaces 7 of the lower first beam 1 and into the slots 17 of the upper second beam 3, while the even longitudinal strings 36" are pushed into the slots 5 of the lower first beam 1 by the gripping surfaces 14. The next lateral string 37' can now be fed through the lacing channel 33, however in the opposite direction as compared to the lateral string 37 of FIG. 4, and thus from right to left as seen in FIG. 6. The lateral strings 37 and 37' following one another naturally form parts of a single extended length of string.

Figure 7:
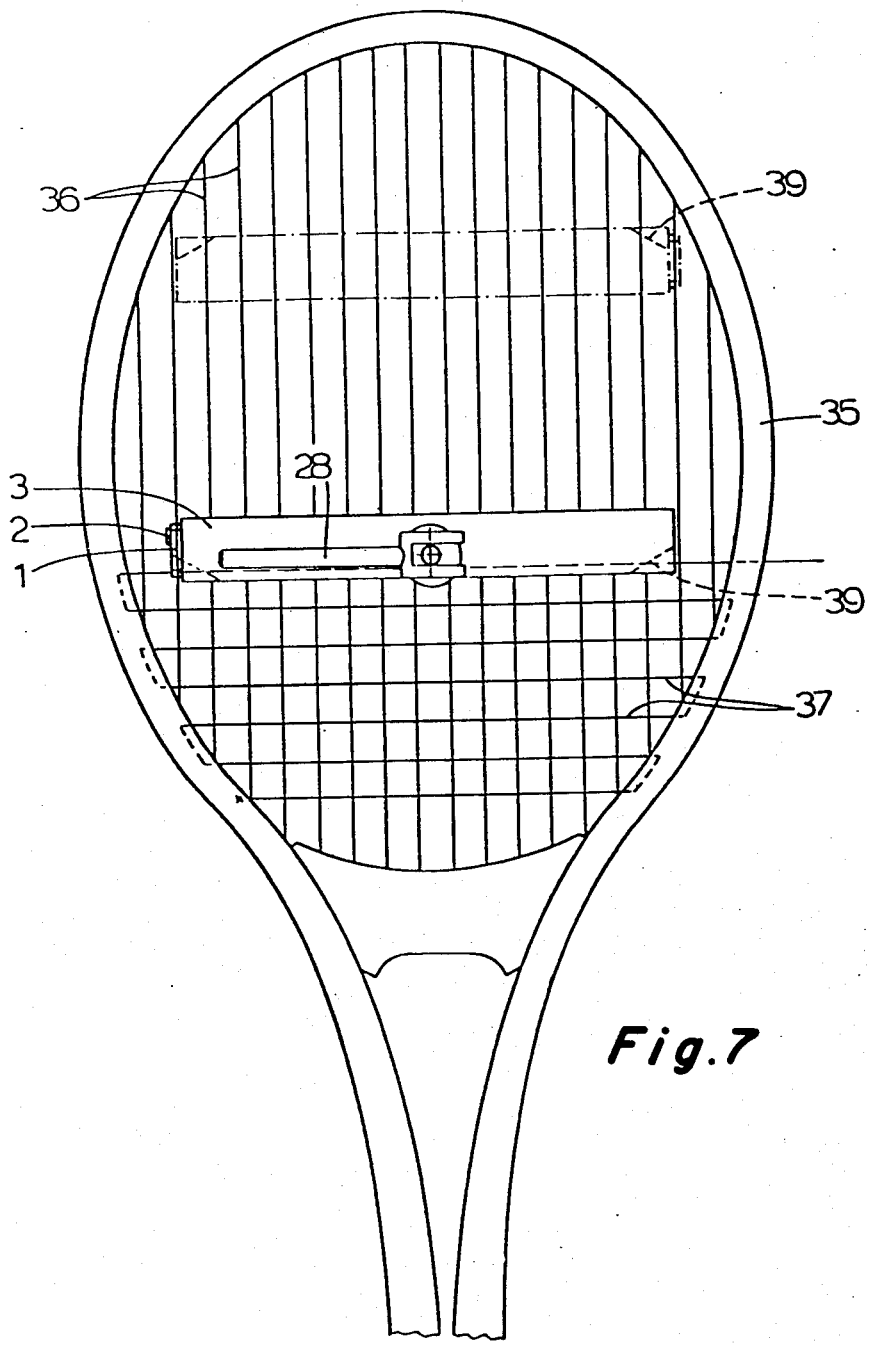
FIG. 7 is a schematic view of a racket with the apparatus placed on the longitudinal strings thereof.

The tennis racket frame 35 shown in FIG. 7 has the normal number of 18 longitudinal strings 36 usual with wooden frames. In order to also allow the lacing in of the short lateral strings at the top and bottom sides of the frame, the apparatus has a length which is shorter than the largest internal width of the racket frame 35 and such that the apparatus allows the outermost longitudinal strings to stay free and thus engages only 16 longitudinal strings. This presents no problem when lacing in the lateral strings since these can be easily passed by hand over or under these outermost longitudinal strings and into and out of the lacing channel. This is, furthermore, facilitated by the small difference in height formed between the even and odd longitudinal strings on the tensioning of the previous lateral string as above described (see FIG. 5).

For lacing in the two lowermost and uppermost lateral strings, the thus shortened apparatus will be pushed so far downward or upward until it engages against the inner side of the frame 35. Although these short outer lateral strings cannot be laced-in in proper alignment with the frame holes concerned, after lacing-in at a somewhat displaced position, they can be pushed easily by hand along the longitudinal strings to the correct position. For these outer strings, the lacing channel 32 or 33 is used which is on the side of the apparatus turned towards the short side of the frame concerned. For lacing-in the lowermost and uppermost lateral strings, the insertion slots 34 can be used in which case at each end of the apparatus the two outer longitudinal strings are passed over. Instead of these inclined insertion grooves 34 and as shown by the dotted lines 39 in FIG. 7, it is also possible to bevel off the first and second beams 1 and 3 at both ends and on the sides thereof opposite to the comb slot 8, 18. These bevelled corner portions 39 allow the apparatus to be shifted further to the short sides of the racket frame, the lacing channel 33 extending between these bevelled corner portions having a shorter length and being more easily accessible at its entrance and exit ends. After feeding in the first two (or three) strings on the handle side of the frame for example, in which process the short lacing channel 33 is used, the first and second beams 1 and 3 are removed from the comb 2 remaining on the longitudinal strings, are turned in the horizontal plane through an angle of 180° and are again mounted on the comb 2, so that now the bevelled corners are on the side of the upper end of the racket frame. The lateral strings are then laced further in by using the other lacing channel 32 of normal length while the two uppermost strings can be laced in on the short side of the apparatus.

Figure 2:
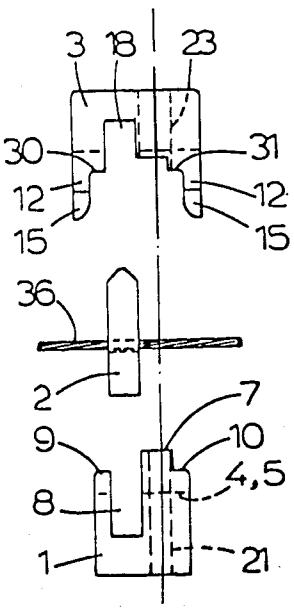
FIG. 2 is an end view of the main components of the apparatus shown in FIG. 1.

The embodiment of the lacing apparatus of FIGS. 1 to 6 has a cross-section of unsymmetrical form as depicted in FIGS. 2 and 3 because the comb 2 lies to one side of the center line in order to provide room for the bores 21 and 23 accomodating the pin 20, 22 of the eccentric-mechanism 19. This means that also the support surfaces 9 and 10 do not lie symmetrical with respect to the comb 2 which may be considered somewhat less desirable.

Figure 8:
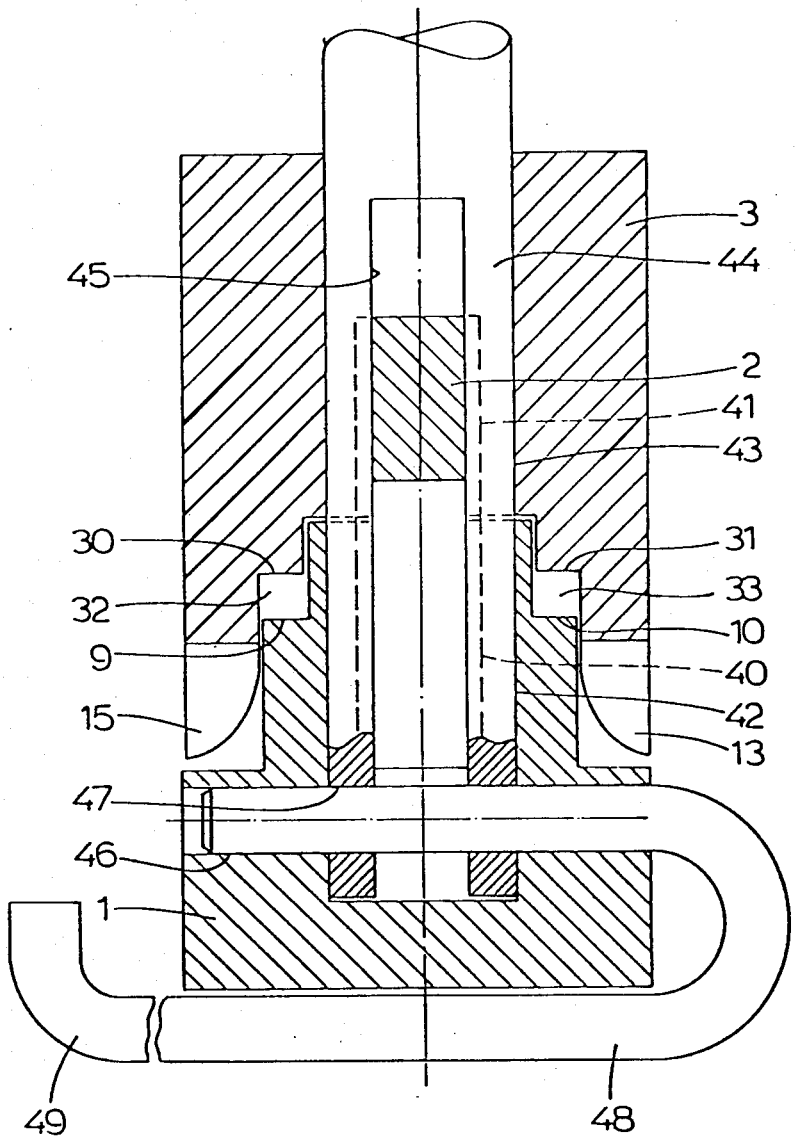
FIG. 8 is a cross-section of another embodiment of the apparatus.

FIG. 8 shows a preferred embodiment in which the comb 2, in this case with its teeth directed vertically downward, lies in a centrally arranged guide-slot 40 in the lower first beam 1 and a corresponding centrally arranged guide-slot 41 in the upper second beam 3 whereby both lacing channels 32 and 33 lie symmetrically with respect to these guide-slots 40 and 41. Square-sectioned apertures 42 and 43 are arranged in the lower first and upper second beams 1 and 3, which apertures extend through the guide-slots 40 and 41, the aperture 42 extending a distance downward past the bottom of the guide-slot 40 in the lower first beam 1. In this case, the eccentric-mechanism 19 of FIG. 1 has a square cross-sectioned pin 44 fitting in apertures 42, 43 and having a longitudinal slot 45 open on its underside which slot slidably accomodates a middle portion of the comb 2 of smaller width. A lateral aperture 46 is provided in the lower first beam 1 in alignment with apertures 47 in the end portions of the pin 44 extending below the comb 2. A resilient locking-pin 48 of "U"-shape is pushed through the apertures 46 and 47 to lock the pin 44 of the eccentric-mechanism 19 in the lower first beam 1. The locking pin 48 can be withdrawn to free the pin 44 of the eccentric-mechanism 19 by pushing it sideways until a bent-up portion 49 at one end engages with the side of the lower first beam 1. In this position, the upper leg portion of the locking-pin 48 is freed from engagement with the pin 44 but remains in engagement with a portion of the aperture 46 in the lower first beam 1.

Figure 9:
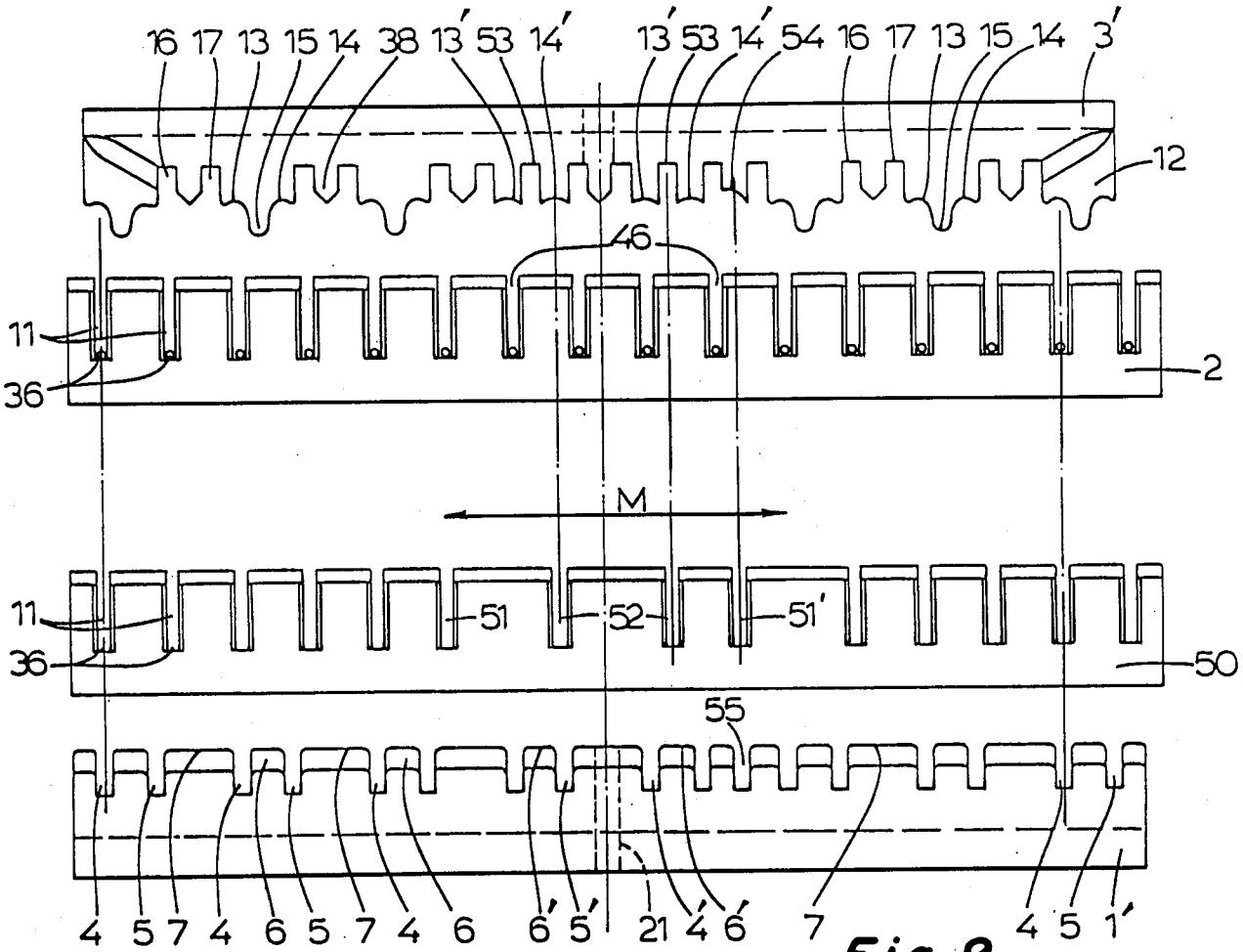
FIG. 9 is a similar view as FIG. 1 of a third embodiment of the apparatus.

In general, the pitch-distance between the longitudinal strings in a wooden racket-frame averages 10 mm which pitch-distance can, however, vary somewhat across the width of the racket frame. By providing the comb 2 with a pitch-distance of 10 mm between comb slots, it is possible to use the apparatus to string pitch-distances which vary up to approximately 10% of the nominal pitch-distance. This is because the comb slots 11 guide the strings in the correct manner to the slots 4, 5 and 16, 17 of the first and second beams 1 and 3 of the apparatus. In the case of such a variation in the pitch-distance, the longitudinal strings will consequently converge or diverge from the comb slots to a small degree which is not objectionable. However, there are other types of tennis racket frames, such as frames with an extra wide frame area, in which the average string pitch-distance of the longitudinal strings is greater than approximately 11 mm and where, moreover, the number of longitudinal strings is generally not 18 but 16. FIG. 9 shows an embodiment of the apparatus by means of which both above mentioned kinds of racket can be strung, and in which the right hand of this Figure shows a variation of the simpler embodiment shown in the left hand half. This apparatus again comprises a lower first beam 1' which has the same distribution of slots as the lower first beam of FIG. 1 but with a few exceptions yet to be described, a first comb 2 for use with a racket having a conventional small string pitch, a second comb 50 for use in stringing a racket with a larger string pitch, and an upper second beam 3' which has the same distribution of gripping-surfaces and slots as those in the second beam 3 of FIG. 1 to which further slots and gripping-surfaces have been added, however.

The additional comb 50 has a central area M which extends over four comb slots 51, 52 instead of the six comb slots in the corresponding central area of the regular comb 2. The comb slots of the comb 50 situated on both sides of this central area are arranged at the same regular pitch-distance of 10 mm as those in the comb 2. In the embodiment shown in the left half of FIG. 9, both the outermost slots 51 of the group of four innermost slots 51, 52 lie in the same place as the outermost slots of the six comb slots occupying the central area M of the comb 2, while the pitch distance between the slots 51 and 52 is greater than the pitch of the slots 11. The two innermost pairs of gripping surfaces 13', 14' of the upper second beam 3' have the same locations as the corresponding pairs of gripping surfaces of the second beam 3 of FIG. 1. In this case, however, the lug 15 between the gripping surfaces of each of these pairs is omitted and is replaced by an additional slot 53. The arrangement is such that the strings 36 lying in the comb slots 52, dependent on the lateral position of the apparatus, can each either move to a slot 53 of the upper second beam while resting on a short support surface 6' of the lower first beam, or be gripped by a gripping surface 13', 14', respectively, so as to be pushed into a slot 4', 5', respectively, of the lower first beam 1'.

In the embodiment shown in the right half of FIG. 9, the slot 51' of the comb 50, in comparison to slot 51, is displaced over some distance towards the middle, to which comb slot 51' there have been added an extra gripping surface 54 situated between two slots 16 and 17 in the upper second beam 3' and an extra slot 55 in the lower first beam 1'.

In using the comb 50 for stringing a racket having 16 longitudinal strings and an enlarged pitch distance between these strings, fourteen of these longitudinal strings are thus gripped by this comb so that the outermost longitudinal strings are not engaged by the apparatus. Due to the greater distance between the four innermost comb slots 51 or 51' and 52 of the comb 50, the average pitch of the comb slots is so adapted to the average pitch of the longitudinal racket strings that the longitudinal strings can be guided through the fourteen slots of the comb 50 without converging too strongly. In this way, the apparatus can also be used for stringing rackets with a large frame as above mentioned without any problems. It is pointed out that within the scope of the present invention, it is possible for the comb slots 11 of the comb 2 not to have mutually equal distances therebetween but to some extent gradually increase the pitch distance between these comb slots from the middle to both ends so as to agree with a correspondingly changing longitudinal string pitch found in many rackets. In that case, the slots and gripping suffaces of both the first and second beams 1 and 3 should, of course, be adapted to the positions of the comb slots.

What is claimed is:

1. An apparatus for lacing the lateral strings in a racket frame which has already been strung with the longitudinal strings thereof, comprising:

a horizontally extending lower first beam, said lower first beam having in its upper surface, a first longitudinal row of spaced vertical slots, the spacing between said slots at least approximately corresponding to twice the average pitch distance between said longitudinal strings of said racket frame, and a second longitudinal row of vertical slots in said first beam upper surface similar to said first row and staggered with respect to said first row, the slots of the first row and adjacent corresponding slots of the second row together forming a plurality of pairs of slots, the spacing between the slots of each pair being smaller than the average pitch distance between said longitudinal strings, and the upper surface of said lower first beam forming a plurality of string support surfaces between said plurality of pairs of slots, an upper second gripper beam extending parallel to and above said lower first beam and vertically movable with respect thereto between an open and a closed position of said apparatus, said second gripper beam comprising gripping means formed on the lower side thereof and in said closed position extending downwardly alongside of said lower beam, said gripping means including a plurality of longitudinally arranged downwardly facing string gripping surfaces each associated with one of said slots of said lower beam, said gripping surfaces being arranged in pairs corresponding to said pairs of slots, and a plurality of downwardly extending lug portions each arranged between the gripping surfaces of at least the majority of the pairs of said surfaces, and means for moving said second gripper beam with respect to said lower first beam between said two positions, said apparatus being adapted to be mounted crosswise on said longitudinal strings of said racket frame with said lower first beam extending below and said upper second gripper beam extending above said strings, whereby in one lateral position of said assembled beams with respect to said longitudinal strings on closing the apparatus, a first group of alternate longitudinal strings are pushed into the slots of said first row of slots by the gripping surfaces associated with said first row of slots; whereas, the remaining longitudinal strings forming a second group of strings intermediate of said first group find support on said support surfaces of said lower first beam so as to form a channel between said first and second group of strings allowing a lateral string to be passed therethrough and whereby after lacing in and tensioning said lateral string and again opening the apparatus, the latter can be shifted in the longitudinal and lateral directions on said longitudinal strings so as to position said second group of strings between the slots and associated gripping surfaces of said second row of slots allowing the location of said channel between said two groups of longitudinal strings to be changed when the apparatus is again closed.

2. The apparatus of claim 1 in which said lower first beam and upper second gripper beam comprise cooperating parts forming in the closed position of the apparatus, a lacing channel for the passage of a lateral string, said lacing channel extending across the whole length of the apparatus at a position lower than said support surfaces of said lower first beam and higher than said gripping surfaces of said upper second gripper beam.

3. The apparatus of claim 1 further comprising a comb member extending longitudinally of said lower first beam and slidably mounted therein, said comb member containing a plurality of vertical comb slots, the pitch distance between said comb slots being equal to half the pitch distance between the slots of each of said two rows of slots in said lower first beam, said comb slots being adapted to receive and guide said lateral strings.

4. The apparatus of claim 1 in which said upper gripper second beam has a substantially U-shaped cross-sectional form with depending faces adapted to receive the lower first beam therebetween in the closed position of the apparatus, said gripping surfaces and depending lug portions being formed in said faces, and said faces further comprising pairs of vertical upper slots situated between said pairs of gripping surfaces and adapted to accomodate therein the longitudinal strings supported on said support surfaces of said lower first beam.

5. The apparatus of claim 4, in which a downwardly facing first shoulder is formed on the inner side of at least one of said faces and in which an upwardly facing second shoulder is formed on said lower first beam opposite said first shoulder, said two shoulders in the closed position of the apparatus together with said face enclosing a longitudinally extending lacing channel for the passage of a lateral string, said face in the open position of the apparatus uncovering said second shoulder.

6. The apparatus of claim 5 in which each of said two faces is formed on its inner side with a downwardly facing first shoulder, each of said two first shoulders cooperating with an associated second shoulder formed on said lower first beam whereby in the closed position of the apparatus, two lacing channels are formed on both sides of the apparatus.

7. The apparatus of claim 3 in which said lower first beam comprises a longitudinally extending guide slot adjacent said string support surfaces, said guide slot slidably receiving said comb member, said member projecting upwardly from said guide slot past said support surfaces, said upper gripper second beam having a corresponding longitudinally extending guide slot receiving the upwardly projecting portion of said comb member in the closed, as well as in the open position of the apparatus.

8. The apparatus of claim 5 in which each of said two faces of said upper gripper second beam is provided in its face and at each of its two ends with an inwardly extending string guiding groove which at its inner end opens into said lacing channel at a distance of at least one pitch distance of said longitudinal string from the adjacent end of said lower first beam.

9. The apparatus of claim 5 in which said lower first beam and upper second beam are provided on one side and at both ends with a chamfer so as to form bevelled surfaces at said ends, said lacing channel opening in said bevelled surfaces at a distance from the lower first beam ends which is greater than the pitch distance of said longitudinal strings.

10. The apparatus of claim 1 in which the apparatus has a length which is shorter than the distance between the two outermost longitudinal strings of the type of racket for which the apparatus is intended to be used.

11. The apparatus of claim 1 in which said means for moving said second gripper beam with respect to said lower first beam comprises a pin detachably secured in said lower first beam, said gripper second beam having a bore adapted to slidably receive said pin so as to allow said gripper second beam to be moved on said pin between said open and closed positions, an eccentric disc rotatably mounted on the upper end of said pin above said gripper second beam and a handle secured to said disc for operating the same whereby said gripper second beam can be moved from the open to the closed position with respect to said lower first beam by a turning movement of said eccentric disc.

12. The apparatus of claim 11 in which said comb member extends midway of the width of said lower first beam, and in which said pin is provided with a longitudinal slot, said comb member passing through said pin slot.

13. The apparatus of claim 3 further comprising a second comb member exchangeable for said first comb member and adapted to be used for stringing a racket frame having a larger average pitch distance between its longitudinal strings, said second comb member having a central area and the number of comb slots in said central area being smaller by two and being more widely spaced than the number and spacing of the comb slots in the corresponding central area of said first comb, the comb slots in the portions outside of said central area having the same number and positions for both comb members, and in which of said two beams at least said gripper second beam is provided with additional slots and gripping surfaces corresponding with the position of the comb slots in said central area of said second comb.

14. The apparatus of claim 13 in which said central area of said second comb comprises four comb slots, the two outermost slots of said four comb slots occupying the same positions as the outermost comb slots of the six comb slots of said central area of said first comb member, the two inner comb slots of said four comb slots of said second comb member being so positioned that they can cooperate with two added slots in said gripper second beam, said added slots being situated between the two gripping surfaces of each of both innermost pairs of gripping surfaces in the upper gripper second beam.

15. The apparatus of claim 13 in which said central area of said second comb comprises four comb slots, wherein the two outermost slots of said four central comb slots are displaced inwardly with respect to the outermost of said six central comb slots of said first comb member and in which said upper gripper second beam has an added gripping surface and said lower first beam has an added slot associated with each of said outermost comb slots of said second comb member.

* * * * *